US010646752B2

(12) United States Patent
Butt et al.

(10) Patent No.: US 10,646,752 B2
(45) Date of Patent: May 12, 2020

(54) METHODS OF MANUFACTURING OF TRI-TECH SOCCER BALL

(71) Applicant: Nouman Idris Butt, Sialkot (PK)

(72) Inventors: Nouman Idris Butt, Sialkot (PK); Riaz Ud-Din Sheikh, Sialkot (PK)

( * ) Notice: Subject to any disclaimer, the term of this patent is extended or adjusted under 35 U.S.C. 154(b) by 165 days.

(21) Appl. No.: 15/068,585

(22) Filed: Mar. 13, 2016

(65) Prior Publication Data

US 2017/0259126 A1 Sep. 14, 2017

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01)

(58) Field of Classification Search
CPC ... A63B 41/08; A63B 45/00; Y10T 156/1052; Y10T 156/1066; Y10T 156/1082
See application file for complete search history.

(56) References Cited

U.S. PATENT DOCUMENTS 9,011,621 B1 * 4/2015 Hussain ..... B32B 7/12 156/147
9,919,189 B1 * 3/2018 Ahmed ..... A63B 41/08
2006/0046880 A1 * 3/2006 Tang ..... A63B 41/08 473/604

* cited by examiner

*Primary Examiner* — Mark A Osele
*Assistant Examiner* — Christopher C Caillouet

(57) ABSTRACT

A sports ball having an exquisite performance cover formed from a plurality of panels of multi-layers sheet with a backing of a softer foamy substance with selective density differences. The cover panels may be joined together at assembling zones. During manufacturing, the foamy substance of the assembling zone is selectively partially cut from the central part of the softer material attached to outer layers for each of the panels. Strips of fabric are further applied and subjected to pressure and high frequency sound waves at assembling zones, providing it the necessary characteristics to better hide the stitching. Punched out central softer material on the inside of the sports ball provides support and a stout rounder shape for the manufacturing of an exquisite performance sports ball and filling up the gap, created between the outer material and bladder, by stitching seams. Assembling zone are further be subjected on the outer side to an adhesive, which further enhance the panel to panel adhesion. The novel techniques used in the manufacturing process results an improved soccer ball with better bounce back affect, stout rounder shape, stability of size and round shape at hitting.

10 Claims, 9 Drawing Sheets

METHODS OF MANUFACTURING OF TRI-TECH SOCCER BALL

TECHNICAL FIELD OF INVENTION

The present invention disclosed relates to a soccer ball and improved methods for manufacturing the soccer ball.

BACKGROUND OF THE INVENTION

Conventional hand stitched, thermo bonded, laminated, what is commonly called hybrid ball and other kinds of soccer balls have certain drawbacks related to handling, costs and performance. Higher amount of materials, energy and labor costs are incurred during the manufacturing of these balls. Hand Stitched ball production method is quite labor intensive and large amount of material is consumed. The durability of balls produced by this technique is also less because of exposure of stitches.

Thermo bonded soccer balls have higher logistic cost as they may not be transported in a deflated condition. Some other conventional techniques adversely affect the performance of the ball by application of restraining force on whole of the backing of the panel cut-outs or labor intensive where each of the panel cut-out further subjected to second layer of foam or softer material. What is commonly called a hybrid ball also has certain drawbacks. Higher amount of fabric is used, which also restricts the proper expansion of foam. Besides that application of second foam is labor intensive.

U.S. Pat. Nos. 8,991,033 B1 and 9,011,621 B1 disclose about methods of manufacturing of soccer ball where shape of the cover panels affected due to compression at edges of uncut foam and reinforcing of two or more foams in later publication also adversely affecting the bounce back affect, stout rounder shape and stability of size at the time of powerful hitting.

The new exemplary embodiments, consistent with the present disclosure, therefore aim to resolve the aforementioned problems and better hiding the stitching, among the prior arts. The present disclosure states the novel techniques used in the manufacturing process results an improved soccer ball with better bounce back affect, stout rounder shape and stability of size at hitting.

SUMMARY

The present disclosure is about novel manufacturing techniques to produce a new and improved soccer ball made up of synthetic leather or leather or plastics stitched cover that exhibits softness and better playing characteristics while maintaining durability of the ball by better hiding the stitching, with better bounce back affect, stout rounder shape and more water resistant by applying additional layer of adhesive at proper stage of manufacturing and proper area.

In an exemplary embodiment, a soccer ball includes a bladder and a plurality of panels. Each of the cover panel cut-outs has a Central Zone and a Peripheral Zone. The peripheral zone is called Assembling Zone. The plurality of panel cut-outs joined together at the outer side of the assembling zones. Assembling zone is up to 10 mm from the edges of the panel cut-outs. In the exemplary embodiment, manufacturing methods of a soccer ball is provided.

Exemplary methods include cutting out a plurality of panel cut-outs from a composite multilayer sheet of padding comprised of at least synthetic leather and foamy substance joined together by application of an adhesive; determining Assembling Zone for each of the plurality of panel cut-outs; applying selective partial cutting; adding support strips; and applying heat or sound waves and pressure on the inner side of the assembling zone of each of the plurality of panel cut-outs. This differentiates the Central part of foamy substance from the assembling zones. The assembling zone may further have an adhesive on the outer side of each of the panel cut-outs.

The method further includes creating a bladder valve panel cut-out by inserting a valve attached to a bladder in one of the plurality of panel cut-outs, may stitching a few of the plurality of panel cut-outs using machine stitching and or welding at the assembling zone, inverting the soccer ball inside out so that the bladder is contained within the soccer ball, may hand stitching and/or heat welding any remaining unstitched assembling zones, subjecting the soccer ball in a non expandable mold and applying heat to the soccer ball and inserting air in the bladder to create internal pressure. The central part of the foamy substance fills up the gap created between the outer material and the bladder, when the adjacent panel cut-outs join.

BRIEF DESCRIPTION OF THE DRAWINGS

The drawings are accompanied with this specification for the purpose of better disclosure of the present invention. These drawings are incorporated in and are a part of description. These illustrations made, along with the description help to explain the steps and principles of the present disclosure as under:—

DETAILED DESCRIPTION

The present invention is about the manufacturing of a new and improved soccer ball by novel manufacturing techniques that exhibits softness and better playing characteristics while maintaining durability of the ball by better hiding the stitching, with better bounce back affect, stout rounder shape and more water resistant by applying additional layer of adhesive at proper stage of manufacturing and proper area.

The present disclosed soccer ball is made up of two major components, a bladder and a cover consisting of plurality of panel cut-outs. Embodiments consistent with the present disclosure enhance the performance of a soccer and other inflatable balls by providing a method and structure for efficient assembling of panel cut-outs and filling up the thickness differences created by stitching by better adjusting the backing components.

Specifically, exemplary embodiments provide for determining assembling zones where panel cut-outs may be joined together. Application of support strips, selective partial cutting, pressure, sound waves may be used to create a selectively depressed area of much less thickness and higher density while still in continuity with the central foamy substance but having a different density and structure where assembling (including stitching) may be carried out. These processes allow the panels to be joined may be by stitching or welding together tightly while still providing a smooth exterior surface in a soccer or other inflatable ball where stitches may have minimal external exposure. The gap created by the in-turning of the assembling zone while joining (stitching) is filled up by the popped up central part of foamy substance created by the selective partial cutting. When an air bladder included within a soccer ball is filled with air at a high pressure in a non-expandable mold, the final smooth and uniform shape of the soccer ball is achieved.

Accordingly, soccer balls that are manufactured by using exemplary methods may have better performance and outer appearance than hand-stitched, thermo bonded balls and balls produced with other known techniques.

Figure 1:
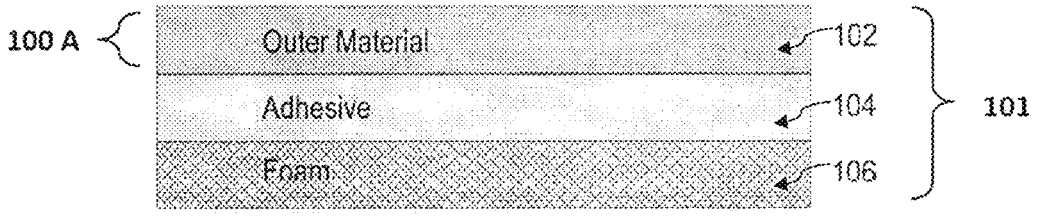
FIG. 1 shows cross-section of multi-layers sheet of soccer ball wherein 100A or 102 is outer layer of bi-cast leather; 104 is layer of applied adhesive and 106 is a layer of foamy substance. 101 means for this composite sheet, collectively.
Figure 2:
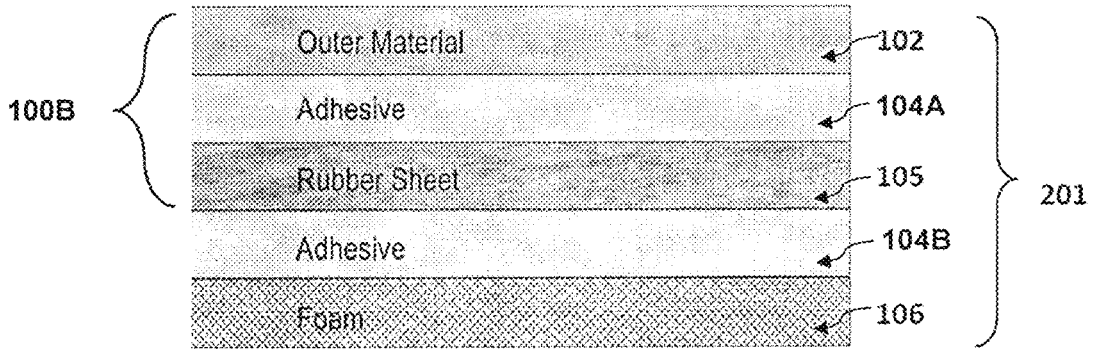
FIG. 2 shows cross-section of multi-layers sheet of soccer ball where 102 is outer layer, 104A and 104B are layer of applied adhesive, 105 is additional layer of rubber and 106 is foamy substance. 100B is comprised layer of outer layer of bi-cast leather, adhesive and rubber sheet. Whereas 201 means for this composite sheet, collectively.
Figure 3:
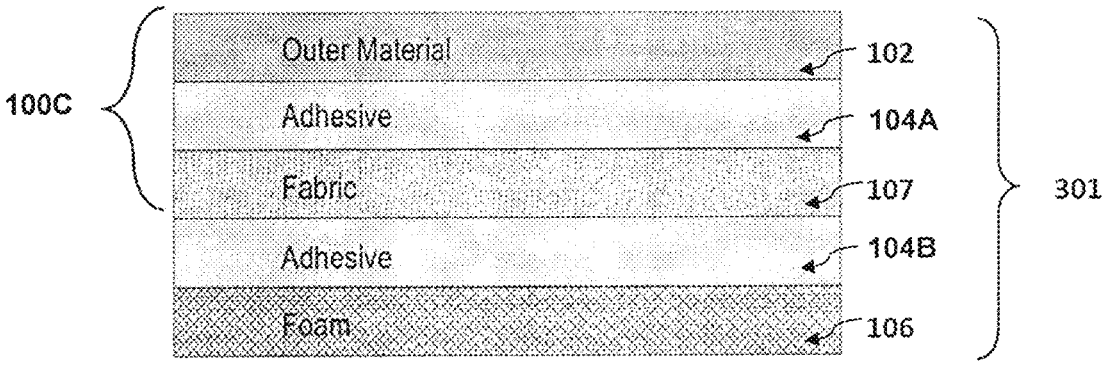
FIG. 3 shows cross-sections of multi-layers sheet of soccer ball where 102 is outer layer, 104A and 104B are layer of applied adhesive, 107 is additional layer of fabric and 106 is foamy substance. 100C is comprised layer of outer layer of bi-cast leather, adhesive and fabric. Whereas 301 means for this composite sheet, collectively.

The soccer ball making cover sheet is a composite multilayer sheet as shown in FIG. 1 to FIG. 3. FIG. reference 101 describes a composite multilayer sheet for making panel cut-outs of a soccer ball which comprising of outer layer 102 which may be a layer of Polyvinyl Chloride (PVC), Polyurethane (PU), or other like synthetic strong material. Outer material layer 102 may be laminated to a sheet of foamy substance 106. The lamination may be completed applying an adhesive 104, such as latex adhesive. In embodiments, outer material layer 102 may have a thickness of 0.03 to 2.0 mm, foamy substance 106 may have a thickness of 2 to 8 mm. Foamy substance may be at least single layer or multiple layers glued to each other. In embodiments, total thickness of a composite multilayer sheet or padding 101 may be up to 10 mm.

The cross section of structure of second type of composite multilayer sheet is shown in FIG. 2 Wherein 201 include an outer material layer 102 which may be a layer of Polyvinyl Chloride (PVC), Polyurethane (PU), or other synthetic material. Outer material layer 102 may be laminated to a layer of rubber sheet 105 using adhesive 104A. This further is laminated to foamy substance 106, using adhesive 104B. In embodiments, outer material layer 102 may have a thickness of 0.03 to 2.0 mm, foamy substance 210 may have a thickness of 2 to 8 mm. Foamy substance 106 may be a single layer or multiple layers glued to each other. In embodiments, total thickness of padding of composite multilayer sheet 201 may be up to 10 mm.

Another structure of composite multilayer sheet is shown in FIG. 3 wherein composite multilayer sheet 301 for making panel cut-outs of a soccer ball, consistent with exemplary embodiments of the present disclosure includes an outer material layer 102 which may be a layer of Polyvinyl Chloride (PVC), Polyurethane (PU), or other synthetic material. Outer material layer 102 may be laminated to a layer of fabric 107 using adhesive 104A. This further is laminated to foamy substance 106, using adhesive 14A. In embodiments, outer material layer 102 may have a thickness of 0.03 to 2.0 mm, foamy substance 106 may have a thickness of 2 to 8 mm. Foamy substance may be a single layer or multiple layers glued to each other. In embodiments, total thickness of padding of composite multilayer sheet 301 may be up to 10 mm.

After the preparation of composite multilayer sheet, cutting out of the panel cut-outs for cover and bladder valve panel cut-out are made from this sheet 400. The panel cut-outs are of specific required shape like hexagon 420, pentagon 410 or any other shape. Layer 400 may represent either type of padding of composite multilayer sheet 101, 201, or 301. There are other possible pattern shapes of panel cut-outs also.

Figure 4A:
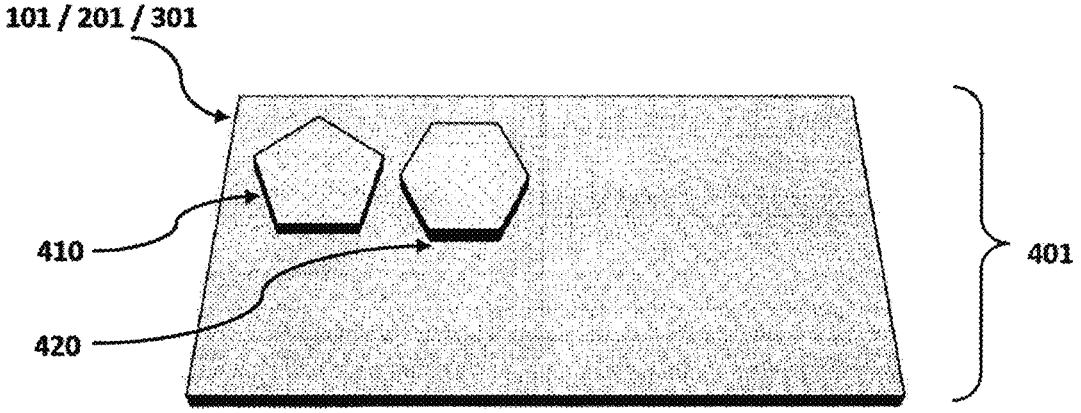
FIG. 4A-C shows multi-layer sheet which may be 101 or 201 or 301. 410 and 420 are panel cut-outs of multi-layer sheet of two different types and sizes.
Figure 4B:
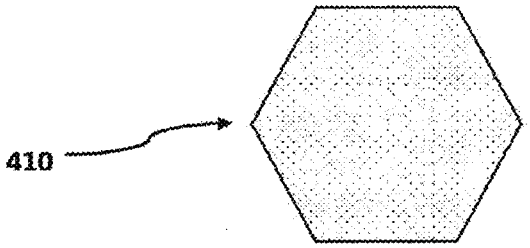
Figure 4C:
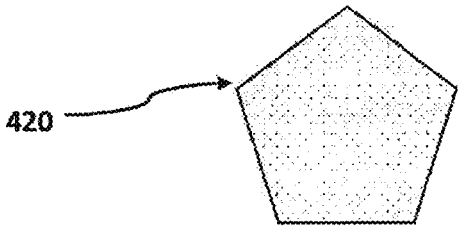
Figure 5:
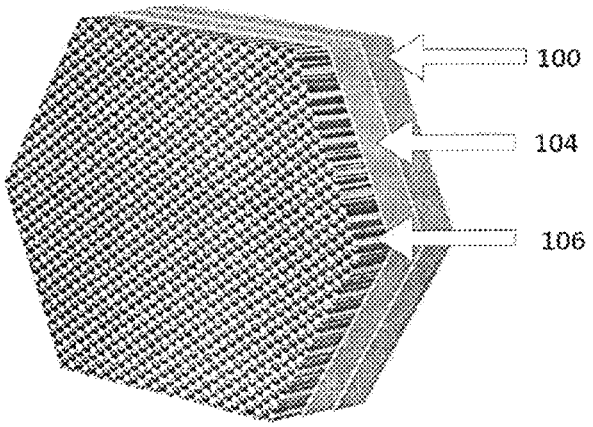
FIG. 5 shows three dimensional view of the panel cut-outs. 100 shows one layer either 100A or 100B or 100C of FIG. 1-3.

The panel cut-outs 410, 420 of FIG. 04 are comprised of at least layer 100 which may include a combined layer either 100*a* or 100*b* or 100*c* of FIGS. 1 to 3, fixed with foamy substance 106 by an adhesive material 104 as shown in FIG. 05.

Figure 6A:
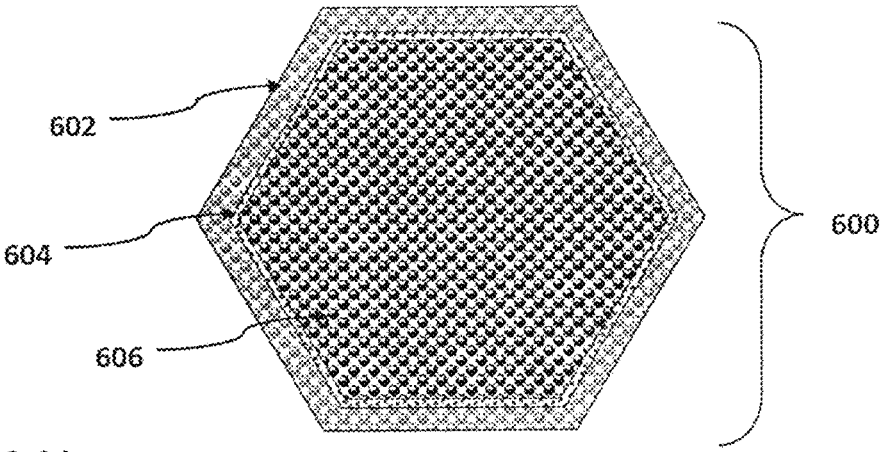
FIG. 6A-B shows are Horizontal views of panel cut-outs indicated as 600 and 601. Where 604 is 2 mm deep selective partial cut in foamy substance. 602 is Assembling Zone. 606 and 607 are central part of foamy substance of panel cut-out.
Figure 6B:
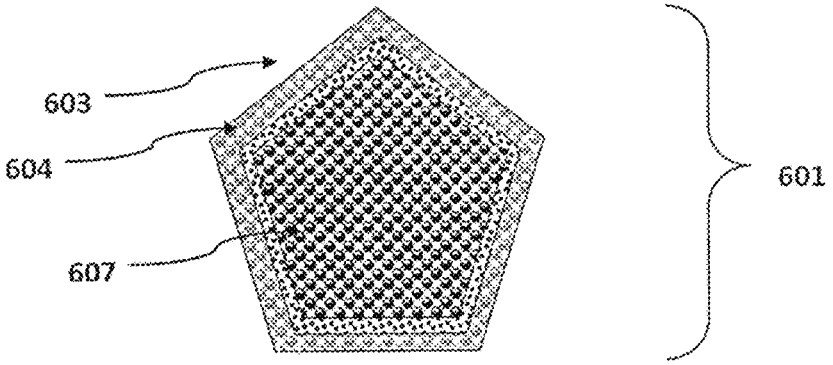

As shown in FIG. 06, the next step is the determination of an area as assembling zone 602, 603 towards inner softer side of the panel cut-outs 410, 420 of up to 10 mm from the edges of the panel cut-outs for each of the plurality of the panel cut-outs which encircles central part of the foamy substance 106. A selective partial cutting 604 of the panels cut outs 410 and 420 from 2 to 6 mm deep and at 4 to 10 mm from the panel cut-out edge near the edge of the support strip is done. As result the central part of the foamy substance is partially cut from the assembling zone 602 or 603, to release pressure of the seams, edges and fabric of the panel cut-out on the foamy substance 106 in the central portion of the panel cut-out.

Figure 7:
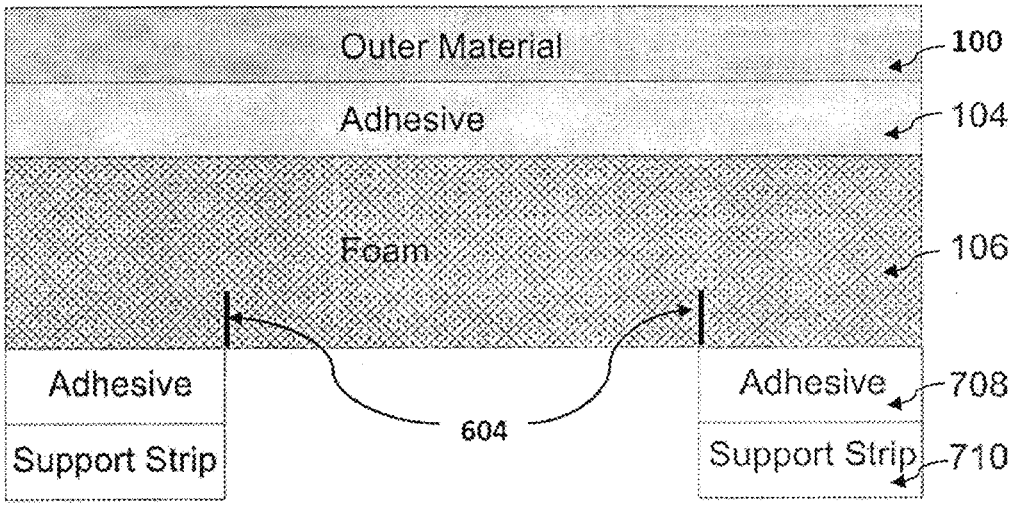
FIG. 7 shows cross-sections of panel cut-out after adjoining Support Strips 710 to multi-layer sheet 401 of FIG. 04 by applying adhesive 708. 604 is 2 mm deep selective partial cut in foamy substance.

After determination of assembling zone 602 or 603 of the panel cut-outs like 410 and 420, the Support Strips 710 have been applied to their edges by applying layer of adhesive 708 as shown in FIG. 07. These strips are up to 10 mm from the edges of the panel cut-outs. FIG. 07 is the cross section of the panel cut-outs 410 and 420. The indicated layer 100 includes either of layer of 100*a* or 100*b* or 100*c* of FIGS. 1 to 3, fixed with foamy substance 106 by an adhesive material 104 as shown in FIG. 05.

Figure 8A:
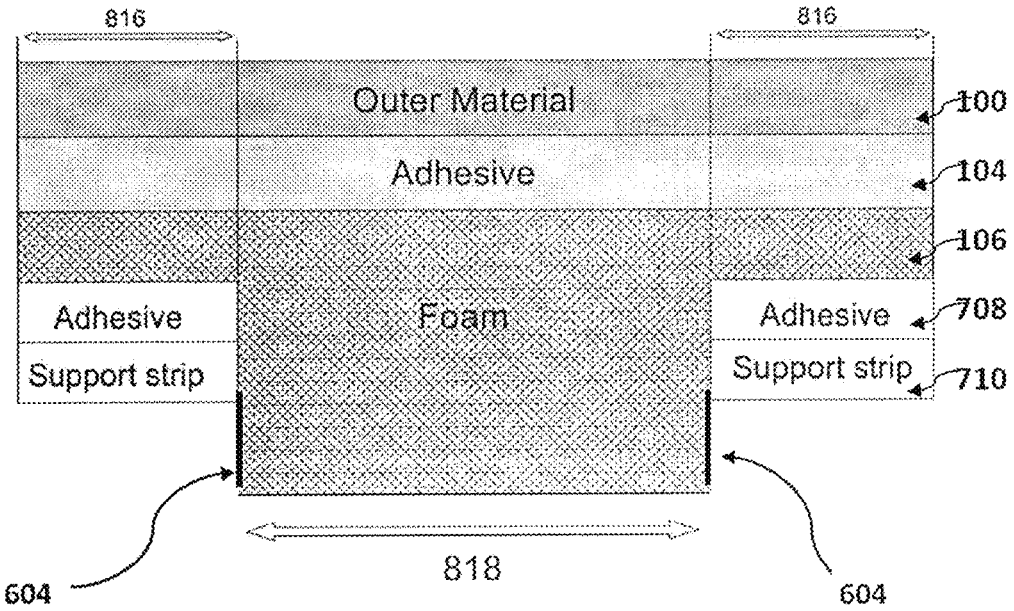
FIG. 8A shows Cross Sections view after Support Strips are being applied at Assembling Zones indicated 816 as after applying high pressure at Assembling Zones. 604 is 2 mm deep selective partial cut in foamy substance. 818 is popped out portion of foamy substance
Figure 8B:
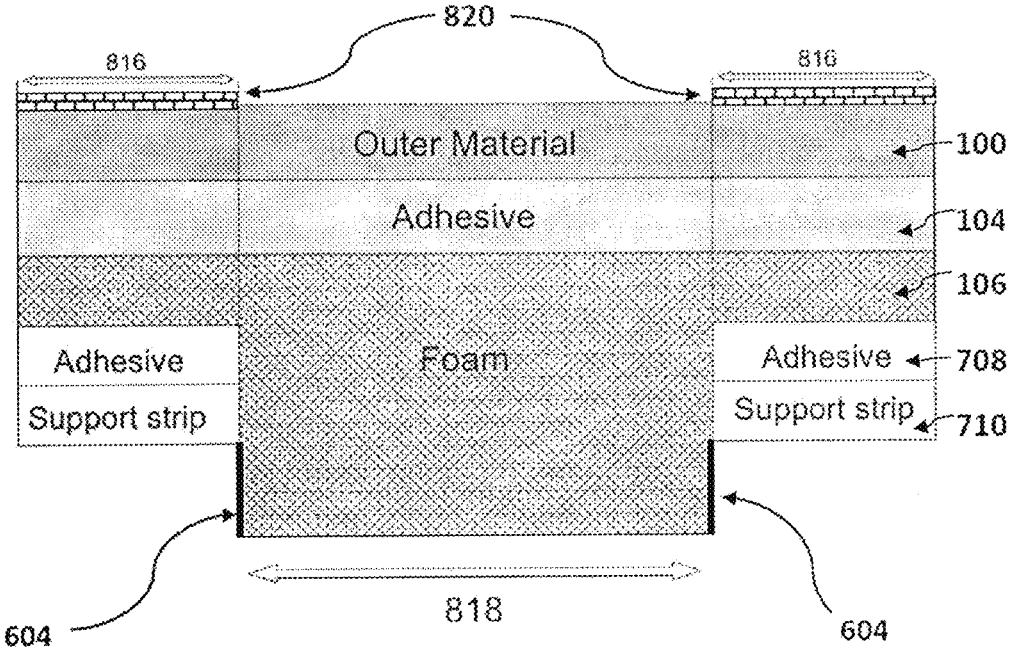
FIG. 8B shows Cross Sections view after Support Strips are being applied at Assembling Zones after applying high pressure at Assembling Zones. 820 shows applied layer of adhesive at assembling zone.

As shown in FIG. 8, Assembling Zones 602 or 603 are created by subjecting Support Strips applied to the edges, to pressure and high frequency sound waves and or heat. The central part of Foamy substance 106 is selectively partially cut 604 and stays unaffected whereas the edges (assembling zone) get pressed. The foamy substance 106 pops-up in the central panel cut-out area 818 whereas is pressed in area 816. The thickness and density of areas 816 and 818 becomes different. The thickness of the assembling zone 816 is significantly reduced and density increased whereas the central part 818 which had been cut, pops out and stays unaffected. The assembling zone may further have an adhesive 820 on the outer side of each of the panel cut-outs.

Figure 9:
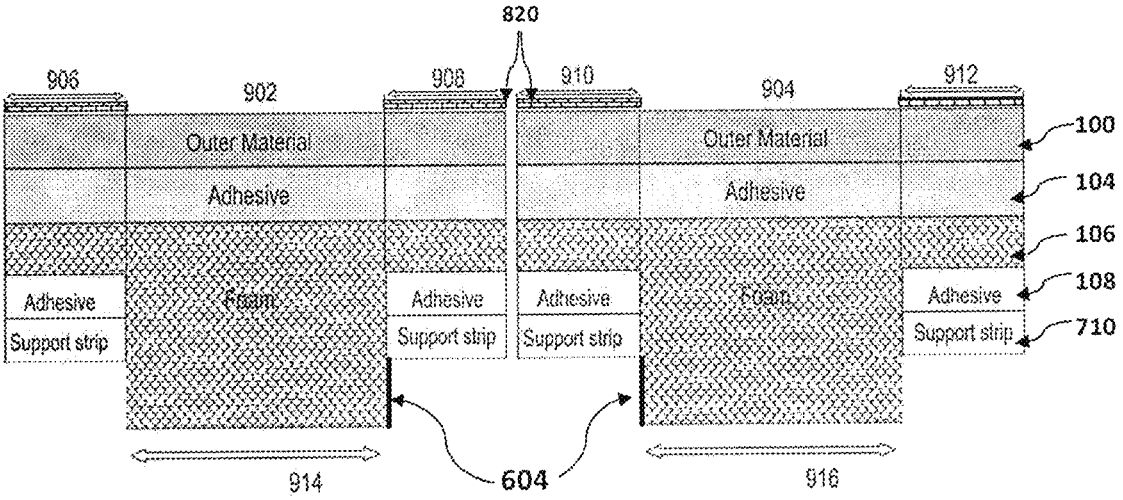
FIG. 9 shows placement of two panel cut-outs before stitching.
Figure 10:
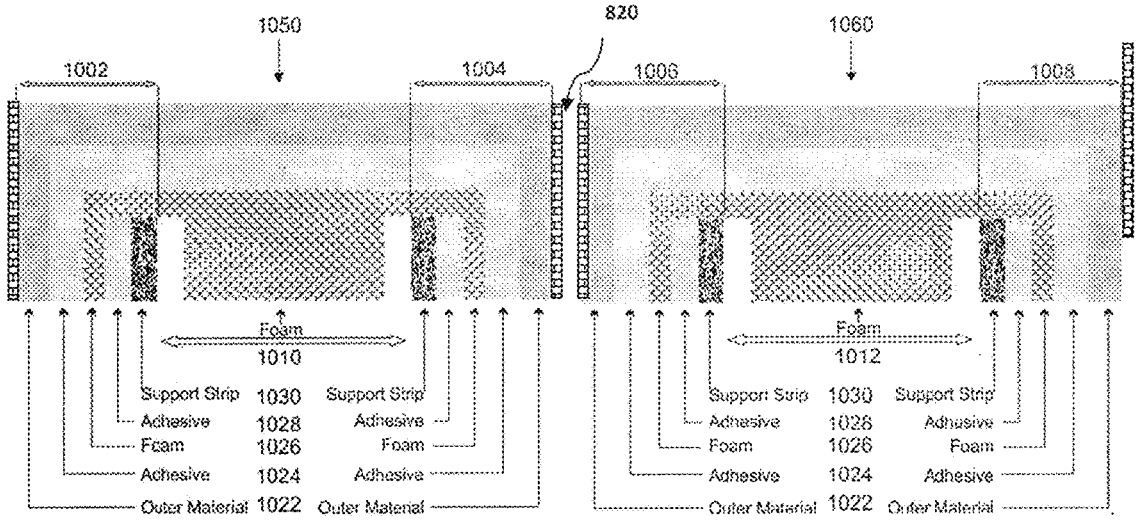
FIG. 10 shows placement of two panel cut-outs with turned or molded assembling zones for stitching.
Figure 11:
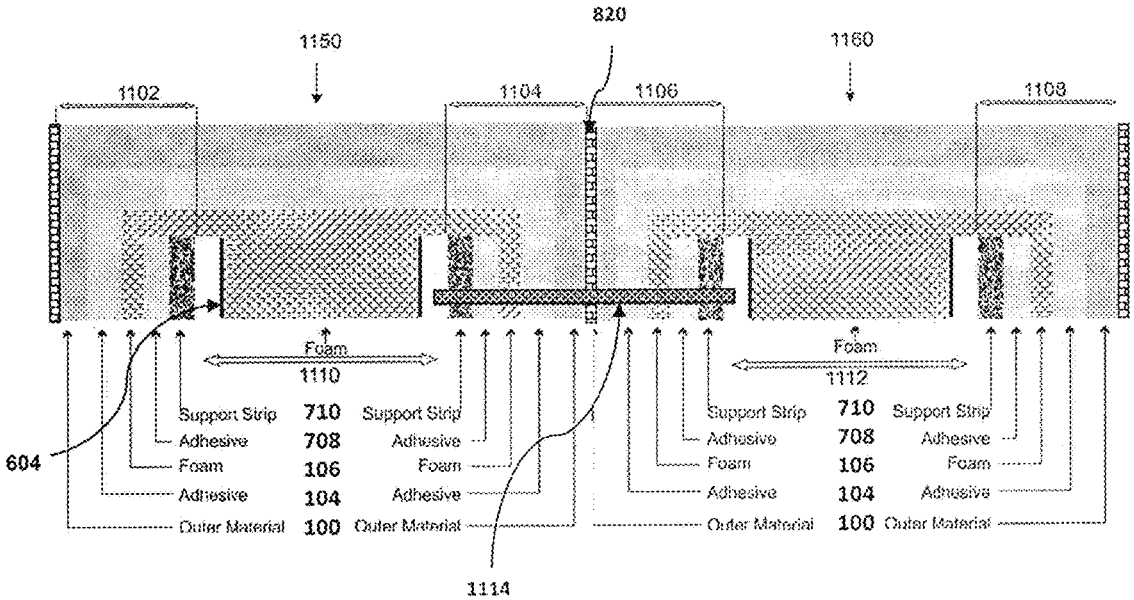
FIG. 11 shows two panel cut-outs stitched together with machine stitch 1114.

As shown cross-sectional view of structure in FIGS. 9, 10 and 11 two panel cut-outs cut outs are placed together to be attached by assembling zones by welding or stitching by machine. The illustrations have been used in the size allowing easier comprehension. Additionally, while FIGS. 9 and 10 show exemplary steps based on padding of composite multilayer sheet 101, similar steps may be applied to padding of composite multilayer sheet 201, 301, or any other suitable material that may be used for panel cut-outs of a sports ball.

FIG. 9 illustrates two cutouts 902 and 904 from padding of composite multilayer sheet 400, with Assembling Zones created, as depicted in FIG. 8. As the thickness, density and physical properties of the assembling zones 906, 908, 910 and 912 have become different from that of the central foamy substance area 914 and 916, the assembling zone has become more suitable for stitching and other joining methods. In an exemplary embodiment, stitching may be applied in the assembling zone at some distance from the edges of the panel cut-outs. The assembling zone and the other processes are not depicted according to the scale but rather are illustrated in a way to make it easy for understanding. The assembling zone may be up to 10 mm and the stitches may be applied in that area. Each cutout of padding of composite multilayer sheet 400 may contain assembling zones where the various cutouts may be stitched to additional cutouts.

The assembling zones of the panel cut-outs are folded to be attached by stitching or welding as shown in FIG. 10 which represents the assembling zones 1002, 1004, 1006 and 1008 are much thinner than the central popped-up zones 1010 and 1012. It represents cutouts 1050 and 1060 in position attained during stitching.

When the stitches are applied in the assembling zone along with layer of adhesive 820 as shown shin FIG. 9-11. The assembling zone 1102, 1104, 1106 and 1108 'in-turns' and the gap so created by in-turning is filled up by the 'popped-up' central zones 1110 and 1112 created by the selective partial cutting 604.

The next step is stitching of respective assembling zones two panes as shown in the FIG. 11 which illustrates stitching 1114 that is applied for stitching together cutouts 1150 and 1160. Stitching 1114 may be applied to all assembling zones of a cutout with assembling zones of various other panel cut-outs.

Figure 12A:
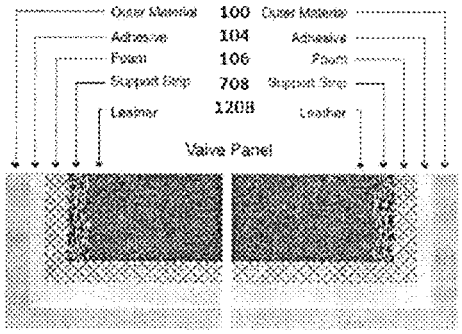
FIG. 12A-C show steps for creating Bladder Valve Panel cut-out of the present disclosure. 1212 is outer opening of valve, 1250 is inner end of valve and 1208 is leather adjoined with multi-layer sheet.
Figure 12B:
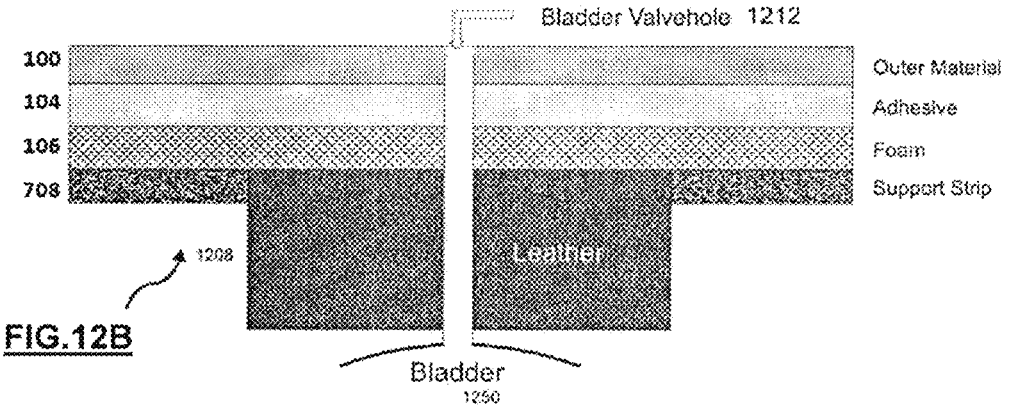
Figure 12C:
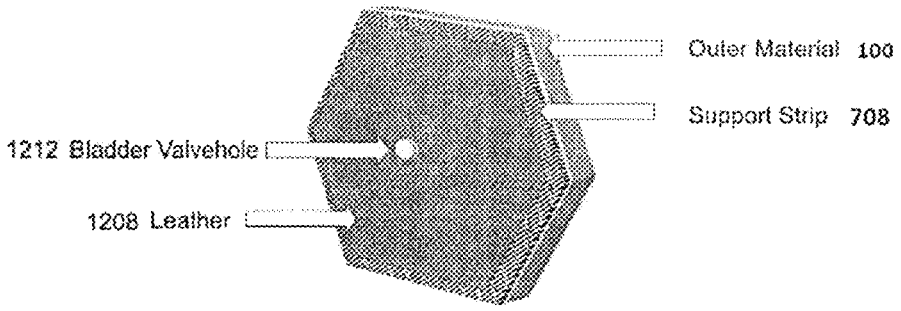

FIGS. 12A, 12B and 12C illustrates the different views of structure of Bladder Valve Panel cut-out. The outer material layer 100 is laminated to the supports strip 708 at the peripheral part and a smaller cutout of leather, similar in shape but smaller in size to the main bladder panel cut-out made from outer material layer 100, is applied to the central part of bladder panel cut-out. Both Support Strip 708 and Leather cutout 1208 are glued to foamy substance 106 by applying a layer of adhesive. There is a Valve Hole 1212, through the bladder panel cut-out which provides passage to the valve part of the bladder 1250.

Figure 13A:
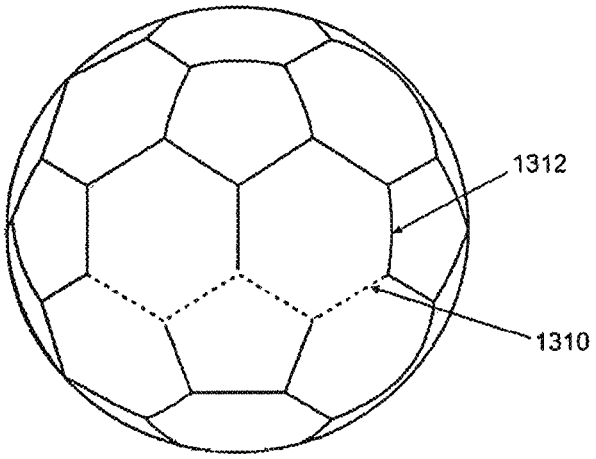
FIG. 13A-B shows some exemplary steps of stitching for joining panel cut-outs of the soccer ball.
Figure 13B:
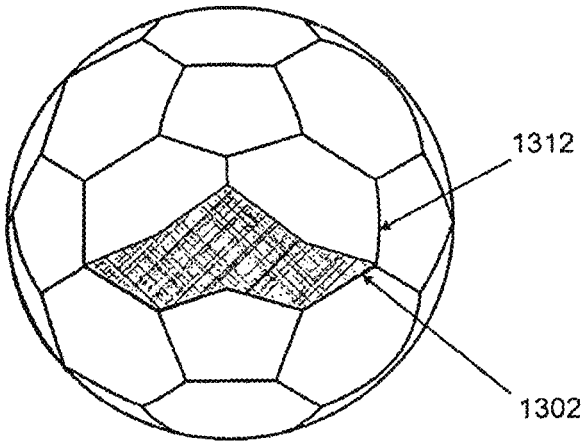

After attaching of all types of panel cut-outs like in the running example hexagon panel cut-out, pentagon panel cut-out and bladder valve panel cut-out by stitching or welding and inverting the newly shaped soccer ball with some remained unstitched area or stitch-line. FIGS. 13A and 13B shows some steps for joining panel cut-outs of a soccer ball. 13A illustrates soccer ball with various panel cut-outs. Panel cut-outs of soccer ball are joined together using machine stitching 1312 as discussed above with respect to FIGS. 8,9,10 and 11. An unstitched portion left for soccer ball inverting 1302 may be hand-stitched. FIG. 13B illustrate a completed stitched soccer ball 1300 with majority of the panel cut-outs being stitched together at assembling zones by applying machine stitching 1312. Some of the remaining panel cut-outs, left after inverting, may be stitched together using hand stitching 1310.

Figure 14:
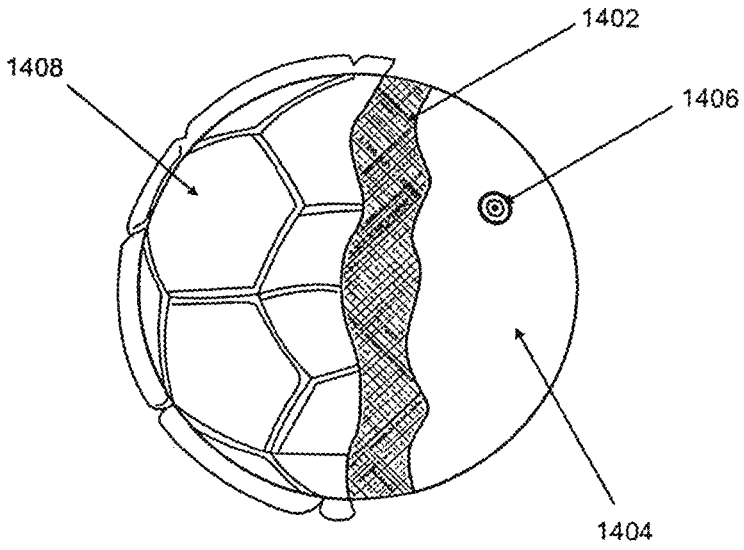
FIG. 14 illustrate a part of which being cut away.
Figure 15:
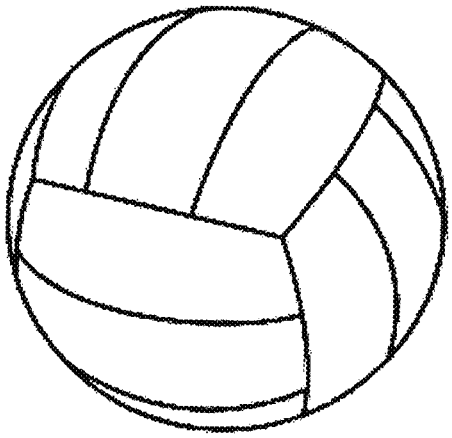
FIG. 15 illustrate a type of soccer ball produced by the method of present invention.

FIG. 14 denotes various components of the newly formed tri-tech soccer ball where 1402 illustrate a bladder made of elastic materials, such as Latex, Natural Rubber, Butyl (or other synthetic rubbers), TPU or other such materials, into which compressed air is charged. 1406 denotes the valve for injecting compressed air. The reference numeral 1404 denotes a reinforced member formed by winding thread, for example, a nylon filament having a length of about 3000 m on to the surface of the bladder 1402 in every direction on a circumference.

The quality of the ball can be enhanced and stabilized by the reinforced layer 1404 as described above. The reinforced layer 1404 can be formed by overlapping a plurality of woven fabrics such as cotton fabrics together and sticking them onto the surface of the bladder 1402 or sewing the woven fabrics spherically as well as winding a thread as described above. In addition, elastomer such as polyurethane, polyester, nylon, etc, which is molded spherically or rubber blended with a reinforced fiber can be used as the bladder. The bladder having such a structure itself has a reinforcing function. Therefore, a special reinforced layer does not need to be provided. The reinforced layer provided on the surface of the bladder is used for the meaning that the bladder having the above-mentioned structure is included. 1408 denotes panel cut-outs, joined together at the assembling zones by the method described previously.

After completing stitching process, the ball is subjected to a non-expandable mold. The air is inserted in the bladder at a high pressure. It creates a high internal pressure with external restriction, resulting in the proper shaping of the ball. The ball adopts its final round shape, once it gets cold. In these conditions, the central part of foamy substance fills up the gap, created between the outer material and the bladder. This provides a uniform appearance both from outside and inside. The ball may further be subjected to adhesive application in the seams.

The balls produced by this method have a cost and performance advantage such as water uptake resistance, softness on the other methods of production. By providing it the necessary characteristics to better hide the stitching. Punched out central softer material on the inside of the sports ball provides support and a stout rounder shape for manufacturing of an exquisite performance sports ball and filling up the gap, created between the outer material and bladder, by stitching seams. Assembling zone are further be subjected on the outer side to an adhesive, which further enhance the panel cut-out to panel cut-out adhesion.

The novel techniques used in the manufacturing process results an improved soccer ball with better bounce back affect, stout rounder shape and stability of size at hitting. The same method of ball production may be used for production of balls for other sports, such as Volleyball, Rugby, Handballs, etc.

What is claimed is:

1. A manufacturing method of a soccer ball, comprising the steps of:

preparing a composite multilayer sheet consisting a plurality of layers including at least a layer of leather or bi-cast leather or plastics fixed with a foamy substance of homogenous density and of size up to 10 mm by applying a layer of adhesive;

cutting out of panel cut-outs and a bladder valve panel cut-out of specific sizes and shapes from the composite multilayer sheet;

determining of an area as assembling zone of up to 10 mm from the edges of the panel cut-outs for each of the plurality of the panel cut-outs which encircles central part of the foamy substance;

strengthening of the assembling zone by applying tape-like support strips of fabric on outer portion but inner side of the panel cut-outs;

selective partial cutting of the panel cut-outs from 2 mm to 6 mm deep and at 4 mm to 10 mm from the panel cut-out's edge near the edge of the support strip so the central part of the foamy substance is partially cut down from the assembling zone;

applying high pressure and high frequency waves to the assembling zone to further enhance the popping-up to create a punched-out effect of the central part of the foamy substance which creates selective changes in the density of the foamy substance at the assembling zone;

applying a layer of adhesive to the outer side of the assembling zone to adjoining two contiguous aforesaid panel cut-outs to enhances the attachment, making it the water resistant, hiding the stitches; and for the stability of probable size change of the soccer ball;

attaching a bladder with the bladder valve panel cut-out which is one of the plurality of the panel cut-outs; and is specially prepared by adjoining combination of leather and the support strips to the foamy substance of the composite multilayer sheet;

stitching of the plurality of the panel cut-outs including the bladder valve panel cut-out by using machine stitching at the assembling zones; and inside inversion of the soccer ball formed by this stitching of the plurality of the panel cut-outs;

Stitching by hand for remaining unstitched stitch-lines of the panel cut-outs the soccer ball; and Insertion of air at a high pressure in the soccer ball while placing in a non-expandable hot mold.

2. The method of claim 1, wherein the composite multilayer sheet is prepared as:

adjoining a layer of bi-cast leather or natural leather or split leather or Polyvinyl Chloride leather or plastic;

applying of a layer of adhesive to at least a bi-cast leather to fix a foamy substance of homogenous density;

introducing one or more additional layer of rubber or synthetic rubber or fabric or like strong substance optionally in between the bi-cast leather and the foamy substance by applying adhesive material on upper and lowers sides of the additional layer.

3. The method of claim 1, wherein support strips made up of rubber, fabric or like strong substance are selectively applied to the assembling zones.

4. The method of claim 1, wherein foamy substance is Ethylene Propylene Diene Monomer (EPDM) rubber or non EPDM foam of homogenous density.

5. The method of claim 1, where selective strengthening of assembling zone creates different behavior and physical properties of the same foamy substance or combination of foamy substances.

6. The method of claim 1 where selective partial cutting of the foamy substance is made to release pressure of the seams, edges and fabric of the panel on the foamy substance in the central portion of the panel cut-out.

7. The method of claim 1, wherein molding the soccer ball in a non-expandable hot mold while inserting high pressure of air in the bladder valve until popped-up foamy substance created by selective strengthening of the assembling zone and release of pressure on the central part of foamy substance by the selective partial cutting of the foamy substance fills up the space between outer layer of aforesaid stitched panel cut-outs and bladder created by the in-turning of edges during stitching.

8. The method of claim 1, wherein the hand stitching may be applied for some remained panel cut-outs.

9. The method of claim 1, wherein a maximum thickness of each of the plurality of the panel cut-outs is 6 mm to 9 mm and the assembling zone thickness at the seam lines is 2 mm to 4 mm.

10. A manufacturing method of a soccer ball, comprising the steps of:

preparing a composite multilayer sheet consisting a plurality of layers including at least an outer layer of leather or bi-cast leather or plastics or polyvinyl chloride fixed with a foamy substance of Ethylene Propylene Diene Monomer (EPDM) rubber or non EPDM foam of homogenous density and of size up to 10 mm by an adhesive;

adjoining one or more additional layer(s) of rubber or synthetic rubber or fabric to bi-cast leather by applying a layer of adhesive material on upper and lowers sides of the additional layer(s);

applying of a layer of adhesive to at least a bi-cast leather or additional layer to fix to the foamy substance;

cutting out of panel cut-outs and bladder valve panel cut-out of specific sizes and shapes from the composite multilayer sheet;

determining of assembling zone area of up to 10 mm from the edges of the panel cut-outs for each of the plurality of the panel cut-outs which encircles central part of the foamy substance;

strengthening of the assembling zone by applying tape-like support strips of fabric or rubber are selectively applied to the assembling zones on the outer portion but inner side of the panel cut-outs;

selective partial cutting of the panel cut-outs from 2 mm to 6 mm deep and at 4 mm to 10 mm from the panel cut-out's edge near the edge of the support strip so the central part of the foamy substance is partially cut from the assembling zone, to release pressure of the seams, edges and fabric of the panel cut-outs on the foamy substance in the central portion of the panel cut-outs;

applying high pressure and high frequency waves to the assembling zone to further enhance the 'popping-up' to create a 'punched-out' effect of the central part of the foamy substance which creates selective changes in the density of the assembling zone; making the maximum thickness of each of the plurality of the panel cut-outs is 6 to 9 mm and the assembling zone thickness at the seam lines is 2 mm to 3 mm;

applying a layer of adhesive to the outer side of the assembling zone to adjoining two contiguous aforesaid panel cut-outs to enhances the attachment, making it the water resistant, hiding the stitches; and for the stability of probable size change of the soccer ball;

attaching a bladder with the bladder valve panel cut-out which is one of the plurality of the panel cut-outs; and is specially prepared by adjoining combination of leather and the support strip to the foamy substance;

stitching of the plurality of the panel cut-outs including the bladder valve panel cut-out by using machine stitching at the assembling zones; and inside inversion of the soccer ball formed by this stitching of the plurality of the panel cut-outs;

Stitching by hand for remaining unstitched stitch-lines of the panel cut-outs of the soccer ball; and Insertion of air at a high pressure in the soccer ball while placing in a non-expandable hot mold wherein molding the soccer ball in a non-expandable mold until popped-up foamy substance created by selective strengthening of the assembling zone and release of pressure on the central part of foamy substance by the selective partial cutting of the foamy substance fills up the space between outer layer of aforesaid stitched panel cut-outs and bladder created by the in-turning of the edges during stitching.

* * * * *